US005218766A

United States Patent [19]

Himebaugh

[11] Patent Number: 5,218,766

[45] Date of Patent: Jun. 15, 1993

[54] ROOFING REMOVAL APPARATUS

[76] Inventor: Forrest K. Himebaugh, 300 Pkwy., Box 253, Lake George, Mich. 48633

[21] Appl. No.: 833,366

[22] Filed: Feb. 10, 1992

[51] Int. Cl.[5] ..... B26B 3/00; E04D 15/00

[52] U.S. Cl. ..... 30/170; 81/45

[58] Field of Search ..... 30/169, 170; 299/36, 299/37; 81/45

[56] References Cited

U.S. PATENT DOCUMENTS

| | | | |
|---|---|---|---|
| 3,672,452 | 6/1972 | Miner . | |
| 4,029,152 | 6/1977 | Gerrits . | |
| 4,277,104 | 7/1981 | Sanches | 299/37 |
| 4,663,995 | 5/1987 | Amundson et al. . | |
| 4,673,219 | 6/1987 | Perciful . | |
| 4,691,439 | 9/1987 | Marra . | |
| 4,699,430 | 10/1987 | Nichols | 299/37 |
| 4,709,479 | 12/1987 | Lavelette | 299/37 |
| 4,756,578 | 7/1988 | Mims et al. | 30/170 |
| 4,763,547 | 8/1988 | Dike, Jr. . | |
| 4,858,503 | 8/1989 | Dike, Jr. | 81/45 |
| 4,880,491 | 11/1989 | Jacobs et al. . | |
| 5,001,946 | 3/1991 | Shirlin et al. | 30/169 |
| 5,009,131 | 4/1991 | Alto et al. | 81/45 |
| 5,076,119 | 12/1991 | Wenz | 81/46 |

*Primary Examiner*—Frank T. Yost
*Assistant Examiner*—Paul M. Heyrana, Sr.
*Attorney, Agent, or Firm*—Learman & McCulloch

[57] ABSTRACT

Apparatus for removing fastened roofing material from a roof comprises a frame on which is mounted a vertically reciprocable blade having a leading edge adapted to be accommodated beneath a strip of roofing material. Reciprocal movement of the blade causes roofing material overlying the leading edge to be freed from and lifted off the roof. The frame has supporting wheels and an engine which drives the wheels and lifts the blade. Springs effect downward movement of the lifted blade.

17 Claims, 2 Drawing Sheets

FIG-1
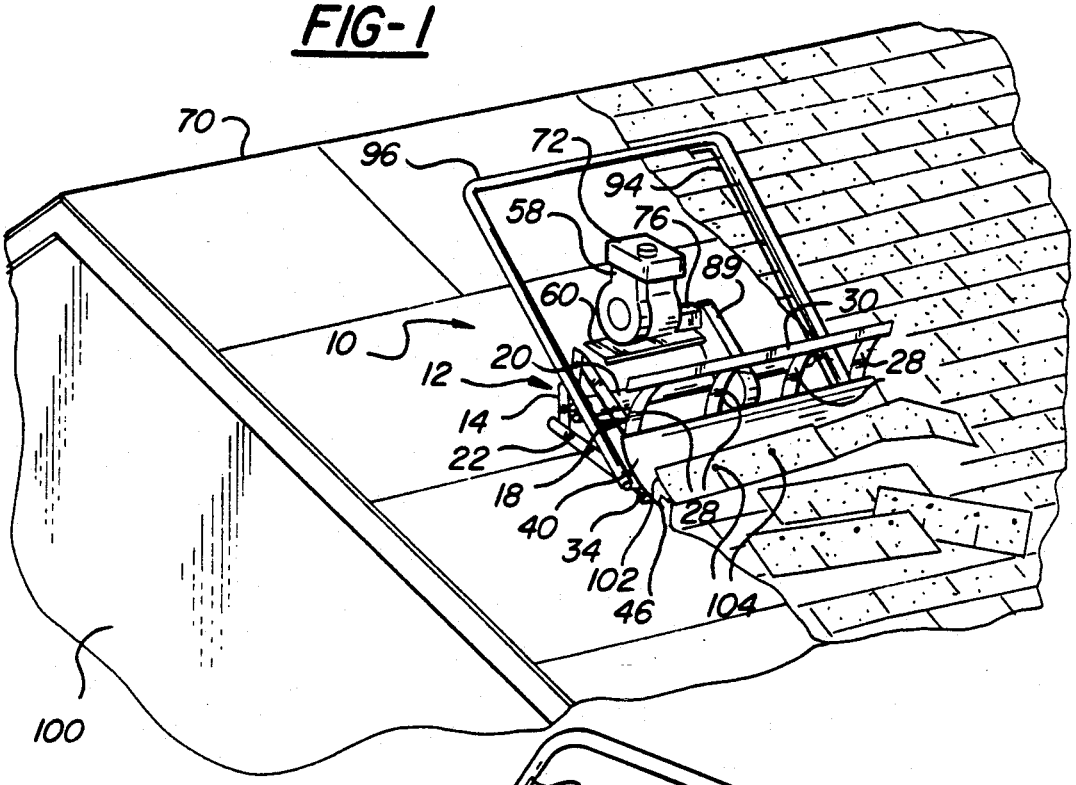
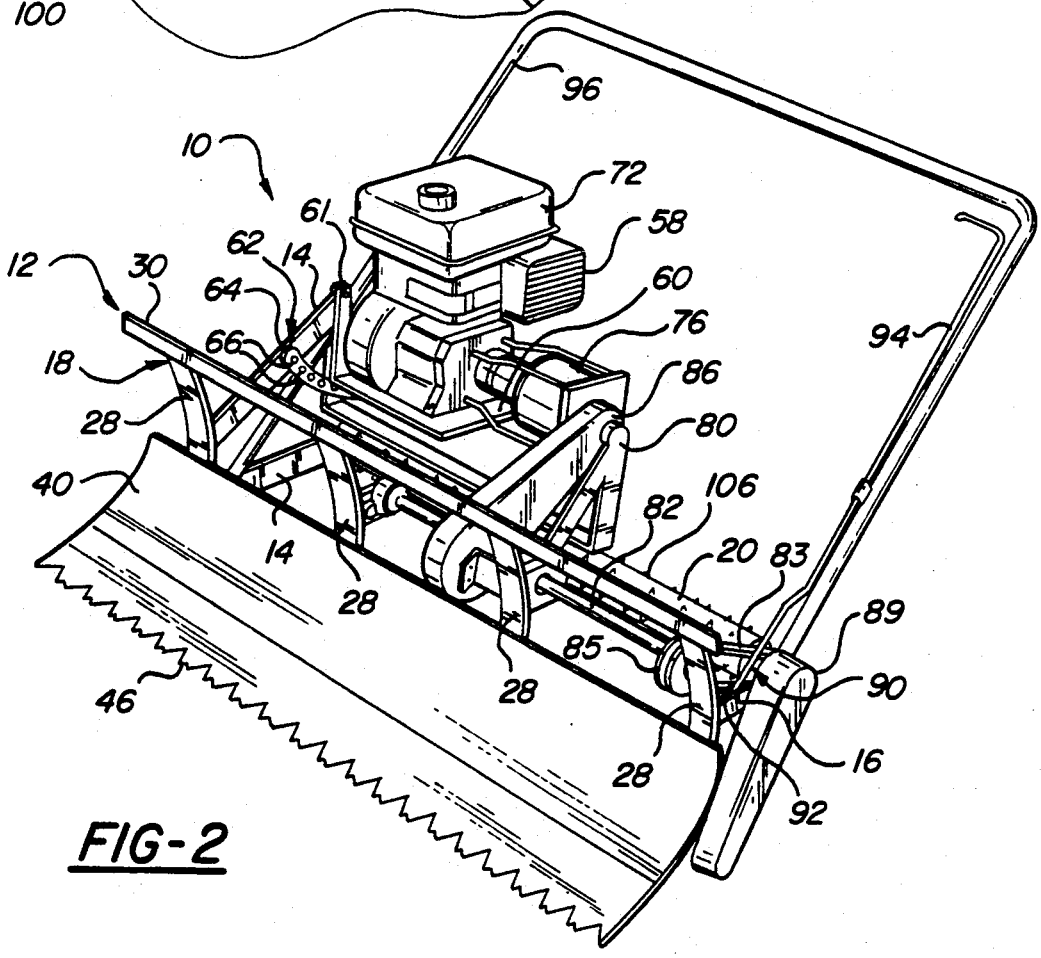
FIG-2

ROOFING REMOVAL APPARATUS

This invention relates to motorized apparatus for use in removing roofing material from a roof.

BACKGROUND OF THE INVENTION

The roofs of pitched buildings are often covered with overlapping courses of shingles for protection against the elements. These shingles are typically fastened to the roof with nails or staples which are driven through the shingles and into the roofing subsurface. Over time, the roofing shingles deteriorate and lose their effectiveness, and require periodic removal and replacement.

Hand tools are most commonly used for unfastening and removing such shingles. This manual removal process, however, is tedious, laborious, and exhaustive as it involves one or more roofers who manually and repeatedly insert the tool beneath a free edge of the shingling material and pry upwardly to withdraw the nails from the roof and free the shingles for removal.

Various power tools have been proposed for overcoming the disadvantages of the manual removal process. These known power tools, however, suffer from various deficiencies and are not known to be commonly used.

One of the power tools proposed heretofore is that disclosed in U.S. Pat. No. 4,673,219 which has a power driven rotatable drum equipped with cutting teeth which forcibly cut and remove the shingles as the drum rotates. This removal process, however, is both inefficient and presents a likelihood of causing damage to the roof from the rotating cutting teeth.

U.S. Pat. No. 4,880,491 discloses a shingle removal tool having a reciprocable power driven blade. The reciprocating movements of the blade cannot withdraw the nails from the roof by lifting the shingles, but rather tends to shear the nails leaving the shanks of the nails secured to the roof. The remaining nail shaft then manually must be extracted or driven flush with the surface of the roof in order to avoid damaging the newly applied roofing material.

U.S. Pat. No. 5,009,131 discloses a shingle removal tool having a powered cutting blade which reciprocates sideways in a horizontal plane for the purpose of cutting the nails. As already mentioned, extracting the nails is preferred over shearing them since the latter requires the remaining nail shaft to be dealt with.

Each of U.S. Pat. Nos. 4,663,995; 4,691,439 and 4,763,547 discloses a shingle removing tool having a power driven lifting plate for lifting the shingles and nails from the surface of the roof. Although these devices have the desirable attribute of lifting the shingles and nails for their removal, the blade lifting mechanisms are fairly complex. Further, these devices are not self-propelled but require an operator to push the devices forwardly.

SUMMARY OF THE INVENTION AND ADVANTAGES

The present invention comprises apparatus for removing fastened overlayment material, such as roofing shingles, from a subsurface such as a roof. The apparatus comprises frame means, vertically reciprocable blade means carried by the frame means for positioning beneath the fastened material, rotary shaft means journaled on the frame means, motor means supported on the frame means for rotating the shaft means, and blade lifting means fixed on the shaft means and rotatable therewith for engaging and intermittently lifting the blade means sufficiently to unfasten and remove any of the material overlying the blade means.

The present invention advantageously allows a workman quickly and safely to remove overlayment from a subsurface in a less laborious manner for readying the subroof for new shingles without a likelihood of damaging the subsurface.

THE DRAWINGS

FIG. 1 is a perspective view of deshingling apparatus constructed according to the present invention in the process of removing shingles from a roof;

FIG. 2 is an enlarged, isometric view of the apparatus;

DETAILED DESCRIPTION

Figure 3:
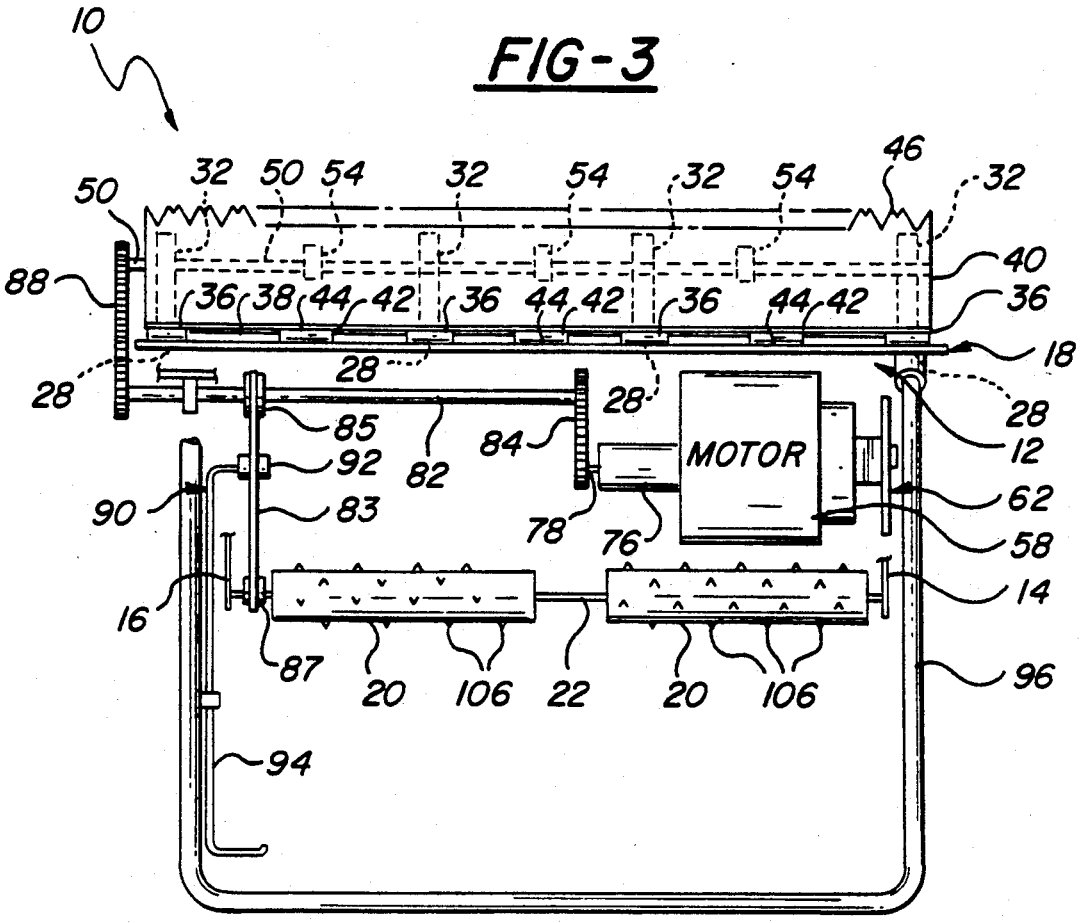
FIG. 3 is a top view of the apparatus.

A preferred embodiment of a powered shingle removing apparatus constructed in accordance with the invention is indicated generally at 10 in the figures. The apparatus 10 includes frame means 12 having a pair of side members 14, 16 and a forward cross member 18 extending transversely of and connecting the two side members 14, 16 together. A pair of identical wheels or rollers 20 are fixed to an axle 22 whose opposite ends are journaled by the rearward ends of the side members 14, 16, respectively, so as freely to be rotatable on the frame 12.

The forward cross member 18 comprises a plurality of generally L-shaped members each having an upstanding and forwardly concave leg portion 28 and a generally horizontal leg portion 32. Extending transversely of and joining the upper ends of the upstanding legs is a connecting member 30. A shearing knife 34 extends across and interconnects the lower ends of the horizontal leg portions 32 and is formed with a sharp forward edge 35 for shearing nails and the like.

Welded or otherwise fixed to the front side of each of the upstanding leg portions 28 is a sleeve 36 (FIG. 3). The sleeves 36 pivotally support a horizontal pivot rod 38 accommodated therein. A scraper blade 40 is coupled to the pivot rod 38 and thereby pivotally supported forwardly of the frame 12. The connection between the scraper blade 40 and the pivot rod 38 comprises a plurality of connector sleeves 42 welded or otherwise fixed to the underside of the scraper blade 40 and fixed to the rod 38 by set screws 44. The pivot rod 38 thus defines a generally horizontal pivot axis about which the scraper blade 40 is rockable.

The scraper blade 40 is forwardly concave and terminates at its lower end in a forwardly projecting leading edge 46. The leading edge 46 is formed with a plurality of serrations or teeth and is adapted to be accommodated beneath a free edge of the roofing material to be removed. The leading edge 46 may be formed of one piece with the remainder of the scraper blade 40 or, preferably, may be formed separately of a material such as hardened steel and then bolted or otherwise fixed to the scraper blade 40.

Rotatably carried on each of the leg portions 32, forwardly of the pivot rod 38 and beneath the scraper blade 40, is a rotary cam shaft 50. The rotary shaft 50 is journaled by a plurality of bearing mounts 52 bolted or otherwise fixed to the associated horizontal leg portion 32. A plurality of plate cams 54 are fixed to the rotary shaft 52 for rotation therewith and in engagement with the underside of the scraper blade 40. Rotation of the cam shaft and the cams periodically lifts the scraper blade 40 upwardly from a rest position, shown by broken lines in FIG. 4, to a vertically raised position, shown by solid lines in FIG. 4. In order to provide additional lift a well as wear resistance, the underside of the scraper blade 40 may be provided with nodes or projections 56 for engagement by the cams 54.

Extending between and connecting the cross member 18 to the scraper blade 40 are one or more tension springs 57. These springs 57 are spaced from the pivot rod 38 and serve forcibly and constantly to urge the leading edge 46 of the scraper plate 40 downwardly toward a lower, rest position. In the rest position the underside of the scraper blade 40 contacts the upper surface of the shear knife 34 and the leading edge 46 is coplanar with the lower surface of the leg portions 32.

A motor, such as a single cylinder gasoline engine 58, is carried by the frame 12 and operatively coupled both to the rollers 20 and the rotary cam shaft 52 for imparting rotation thereto. The engine 58 is mounted on a cradle 60 which, in turn, is pivotally mounted on a side member 14 of the frame 12 by a pivot pin 61. The engine 58 thus is capable of rocking fore and aft about the substantially horizontal axis of the pivot pin 61 in order to assume any selected one of a plurality of pivotally adjusted positions.

Adjustable retaining means 62 is provided for retaining the engine 58 in a selected position of pivotal adjustment relative to the frame 12 and comprises an arcuate retaining arm 64 welded or otherwise suitably fixed to the cradle 60 and movable therewith relative to the frame 12. The retaining arm 64 is formed with a plurality of openings 66 spaced at preselected intervals along its length. A pin 68 extends through an aperture in the side member 14 and may be accommodated in any one of the openings 66 registered therewith for retaining the engine 58 in the selected position of pivotal adjustment.

Figure 5:
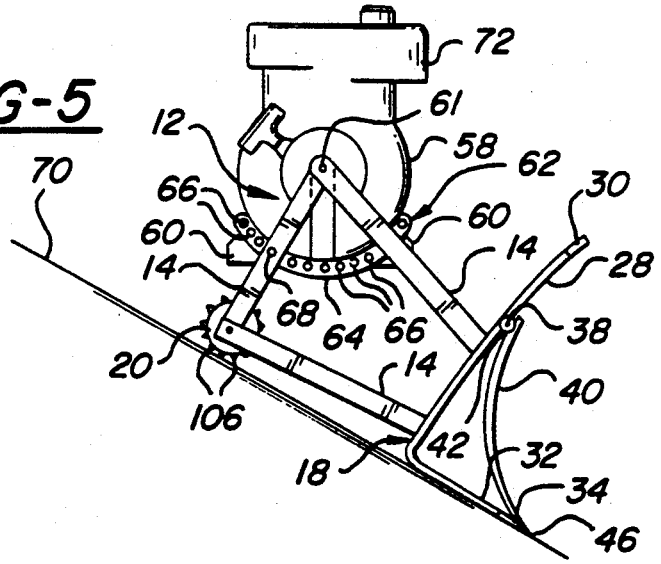
FIG. 5 is a fragmentary side view on a reduced scale of the apparatus.

The pivotal connection and retaining means enable the engine 58 to be adjusted and supported on the frame 12 so as to assume a substantially upright position with the engine's gasoline tank 72 substantially horizontal for proper operation when the apparatus 10 is being operated on the inclined surface of a roof 70, as shown in FIG. 5. The selected position of adjustment is dependent upon the pitch of a particular roof being stripped of shingles as well as whether the apparatus 10 is operating from top to bottom or vice versa on the roof.

The engine 58 is coupled to a gear reducing mechanism 76 whose output shaft 78 is journaled by a support bracket 80 projecting laterally and upwardly of the side member 14 beneath the cradle 60. A transfer shaft 82 is rotatably supported off a backside of the upstanding leg portions 28 of the cross member 18 and is coupled to the output shaft 78 by a chain and sprocket linkage 84 protected by shield 86. The transfer shaft 82 is coupled to the axle 22 via a drive belt 83 and pulleys 85, 87 and is further coupled to the rotary cam shaft 52 through a chain and sprocket linkage 88 protected by a shield 89.

The belt and pulley linkage 83, 85, 87 has associated therewith a clutch mechanism 90 for selectively coupling and uncoupling the transfer shaft 82 and the axle 22. The clutch mechanism 90 comprises a belt tensioning cam 92 carried by the frame 12 for selectively pivoting toward an into tensioning engagement with the drive belt 8 to selectively transfer the rotary motion of the shaft 82 to the axle 22 and thus drive the drums 20. A control arm 94 extends from the cam 92 and is slideably supported by a U-shaped handle 96 whose free ends are attached to the side members 14 and 16 of the frame 12 and extend upwardly and rearwardly therefrom for enabling the position of the cam 92 to be conveniently controlled by an attendant operating the machine 10 while holding onto the handle 96.

In operation, the apparatus 10 is first transported to the inclined roof 70 of a building 100 (FIG. 1) and oriented with the scraper blade 40 directed down the incline. The engine 58 is pivotally adjusted so that it is substantially upright with respect to the ground and the engine's gas tank 72 approximately horizontal. The retaining pin 68 is extended through an aligned opening 66 in the retaining arm 64 to secure the engine 58 in the selected position of adjustment.

Figure 4:
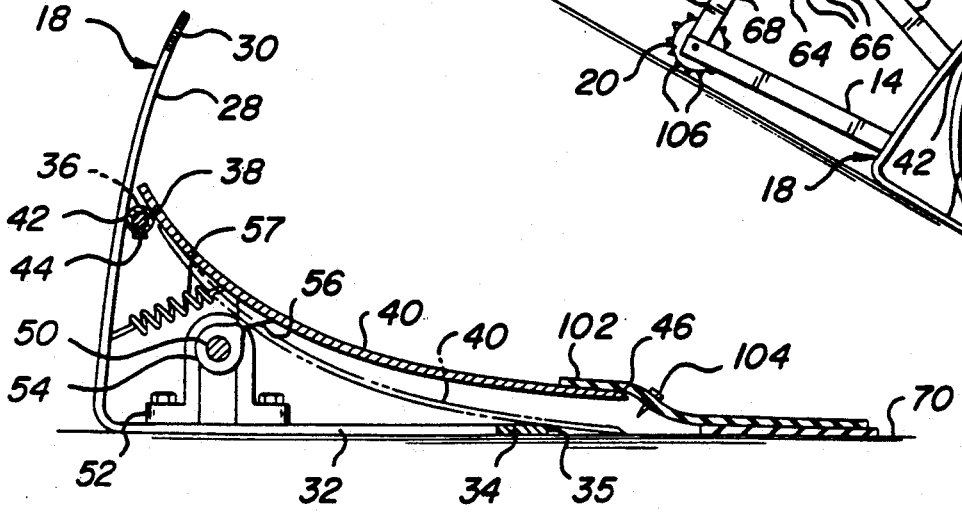
FIG. 4 is a fragmentary, cross-sectional view illustrating the interaction between components of the apparatus.

The leading edge 46 of the scraper blade 40 is then positioned beneath a free edge of roofing material 102 which is fastened to the roof 70 by a plurality of staples or nails 104, as illustrated in FIGS. 1 and 4. The engine 58 is started and run so that rotary motion is imparted to the transfer shaft 82 via the chain and sprocket assembly 84. The rotary motion of the transfer shaft 82 in turn imparts rotation to the rotary shaft 52 and the cams 54 via the chain and sprocket linkage 88, as shown in FIGS. 3 and 4. As the cams 54 rotate, their lobes engage the nodes 56 of the scraper blade 40 causing the scraper blade 40 to move upwardly from the rest position (shown in phantom in FIG. 4) to the vertically raised position (shown in solid lines in FIG. 4). Any fastened roofing material 102 overlying the scraper blade 40 will be lifted with the blade 40, as shown in FIG. 4, and cause most, if not all, of the nails 104 associated therewith to be withdrawn from the surface of the roof 70.

The rear wheels 20 can be engaged to assist in driving the apparatus 10 forwardly by simply actuating the clutch assembly 90. The wheels 20 may also be provided with cleats 106 for added traction.

The driving action of the wheels 20 combined with the intermittent lifting action of the scraper blade 40 enables the shingling apparatus 10 progressively and continuously to remove large sections of roofing material in a very short period of time.

As the lobes of the cams 54 disengage the nodes 56, the tension springs 98 sharply urge the scraper blade 40 downwardly causing it sharply to impact the shearing knife 34. If, for some reason, the scraper blade 40 fails to extract a nail 104, the sharp leading edge 35 of the shearing knife 34 will shear off the head of the nail leaving only the shank of the nail in the roof. As the apparatus 10 is driven further forwardly, the shearing knife 34 will overlie the top of the remaining nail shank which will then be driven flush with the surface of the roof by the sharp impacting action of the scraper blade 40 against the shearing knife 34.

As the roofing material is lifted and stripped from the roof 70, it is deflected upwardly and forwardly by the curvature of the scraper blade 40 and upstanding leg portions 28. This is advantageous when stripping the roofing material down the incline of the roof since the stripped material will be continuously deflected and rolled forwardly on the roof ahead of the apparatus 10.

Although particular reference has been made to the stripping of roofing material, it will be appreciated that the apparatus is equally useful for stripping other overlayment materials from a subsurface, such as floor covering materials and the like.

The disclosed embodiment is representative of a presently preferred form of the invention, but is intended to be illustrative rather than definitive thereof. The invention is define dint he claims.

What is claimed is:

1. Apparatus for removing fastened overlayment material from a subsurface, said apparatus comprising frame means; blade means having a forward edge adapted to be accommodated between the subsurface and the fastened material; pivot means mounting said blade means on said frame means for rocking movements about an axis and disabling said blade means form linear fore and aft movement relative to said frame means; rotary shaft means journaled by said frame means; motor means supported by said frame means and coupled to said shaft means for rotating said shaft means; and blade lifting means coupled to said shaft means for rotation therewith and engagable with said blade means between said axis and the forward edge of said blade means for rocking said blade means about said axis form a rest portion to a vertically raised position and thereby lift any of the material overlying the forward edge of said blade means.

2. Apparatus according to claim 1 including biasing means for constantly urging said blade means toward the rest position.

3. Apparatus according to claim 1 wherein said blade lifting means comprises at least one cam fixed to said shaft means and engageable with said blade means.

4. Apparatus according to claim 1 wherein said blade means comprises a scraper plate pivotally mounted on said frame means.

5. Apparatus according to claim 1 wherein said leading edge is serrated.

6. Apparatus according to claim 1 wherein said rotary shaft means is beneath said blade means and rotation of said rotary shaft means causes said blade lifting means to engage and periodically lift said blade means upwardly.

7. Apparatus according to claim 1 including supporting wheel means rotatably mounted on said frame means.

8. Apparatus according to claim 7 including coupling means operatively coupling said motor means to each of said shaft means and said wheel means for imparting rotation thereto.

9. Apparatus according to claim 1 wherein said motor means is pivotally coupled to said frame means for pivotal movement to a selected one of a plurality of adjusted positions relative to said frame.

10. Apparatus according to claim 9 including retaining means for retaining said motor means in said selected one of said adjusted positions.

11. Apparatus according to claim 1 wherein said motor means comprises a gasoline engine.

12. Apparatus according to claim 1 including a shearing knife carried by said frame means below said blade means, said shearing knife having a sharp forward edge for shearing any fasteners not lifted by said blade means, said blade means impacting said shearing knife when returning to said rest position for driving any remaining portion of the sheared-off fasteners underlying said shearing knife flush with the subsurface.

13. Apparatus for removing overlayment material secured to a subsurface with fasteners, said apparatus comprising: frame means; blade means adapted to be accommodated between said subsurface and the fastened material; pivot means mounting said blade means on said frame means for rocking movements about an axis and disabling said blade means from linear fore and aft movement relative to said frame means; blade lifting means for rocking said blade means about said axis between a rest position and a vertically raised position to lift any of said material overlying said blade means; and shearing knife means carried by said frame beneath said blade means for shearing any fasteners not lifted by said blade means, sad blade means impacting said shearing blade means when returning to said rest position for driving any remaining portions of sheared off fasteners underlying said shearing knife means into the subsurface.

14. Apparatus according to claim 13 including biasing means for constantly urging said blade means toward the rest position and causing said blade means forcibly to contact said shear knife means.

15. Apparatus according to claim 13 wherein said blade lifting means comprises at least one cam fixed to a rotary shaft carried by said frame means.

16. Apparatus according to claim 15 wherein said rotary shaft is beneath said blade means and rotation of said rotary shaft means causes said cam periodically to lift said blade means upwardly.

17. Apparatus according to claim 13 wherein said blade means comprises a scraper plate pivotally mounted to said frame means.

* * * * *

UNITED STATES PATENT AND TRADEMARK OFFICE

CERTIFICATE OF CORRECTION

PATENT NO. : 5,218,766

DATED : June 15, 1993

INVENTOR(S) : Forrest K. Himebaugh

It is certified that error appears in the above-identified patent and that said Letters Patent is hereby corrected as shown below:

Column 3, line 11, change "a" to -- as --.

Column 4, line 3, change "8" to -- 83 --.

Column 5, line 7, change "define dint he" to -- defined in the --; line 15, change "form" to -- from --; line 24, change "form" to -- from --.

Column 6, line 31, change "sad" to -- said --.

Signed and Sealed this

Eleventh Day of January, 1994

Bruce Lehman

*Attest:*

BRUCE LEHMAN

*Attesting Officer*

*Commissioner of Patents and Trademarks*